US009101804B2

(12) United States Patent
Brenner

(10) Patent No.: US 9,101,804 B2
(45) Date of Patent: Aug. 11, 2015

(54) HOCKEY GOALIE STICK

(71) Applicant: Corey Brenner, Lanesborough, MA (US)

(72) Inventor: Corey Brenner, Lanesborough, MA (US)

( * ) Notice: Subject to any disclaimer, the term of this patent is extended or adjusted under 35 U.S.C. 154(b) by 61 days.

(21) Appl. No.: 14/083,218

(22) Filed: Nov. 18, 2013

(65) Prior Publication Data

US 2015/0126310 A1 May 7, 2015

Related U.S. Application Data

(60) Provisional application No. 61/898,875, filed on Nov. 1, 2013.

(51) Int. Cl.
*A63B 59/14* (2006.01)
*A63B 59/00* (2015.01)

(52) U.S. Cl.
CPC ..... *A63B 59/0014* (2013.01); *A63B 59/14* (2013.01)

(58) Field of Classification Search
CPC ..... A63B 59/14
USPC ..... 473/560–563
See application file for complete search history.

(56) References Cited

U.S. PATENT DOCUMENTS

| | | | | | |
|---|---|---|---|---|---|
| 1,183,473 | A | * | 5/1916 | McNiece | 473/560 |
| 3,940,135 | A | | 2/1976 | Cohen | |
| 4,168,062 | A | | 9/1979 | McCarthy | |
| D263,329 | S | | 3/1982 | Clayton | |
| 4,544,157 | A | * | 10/1985 | Curtis | 473/560 |
| D344,115 | S | * | 2/1994 | Goyette | D21/727 |
| 5,320,350 | A | | 6/1994 | Savage | |
| 5,456,463 | A | | 10/1995 | Dolan | |
| D406,625 | S | | 3/1999 | Hutzenlaub | |
| 6,099,421 | A | * | 8/2000 | Mayhew | 473/560 |
| D431,621 | S | | 10/2000 | Pagotto | |
| D444,520 | S | | 7/2001 | O'Malley | |
| 6,330,950 | B1 | | 12/2001 | Loika | |
| 6,643,844 | B2 | | 11/2003 | Morrow | |
| D496,703 | S | * | 9/2004 | Gans | D21/727 |
| 6,921,347 | B1 | | 7/2005 | Morrow | |
| 7,282,001 | B2 | | 10/2007 | Ponzini | |
| 7,621,829 | B2 | | 11/2009 | Barkume | |
| D684,225 | S | * | 6/2013 | LaCroix | D21/727 |
| 2002/0121742 | A1 | | 9/2002 | Stauber | |
| 2004/0087391 | A1 | | 5/2004 | Stauber et al. | |
| 2006/0217218 | A1 | | 9/2006 | Ponzini | |
| 2006/0281591 | A1 | * | 12/2006 | Wikstrom et al. | 473/560 |
| 2010/0323829 | A1 | * | 12/2010 | Cross et al. | 473/560 |
| 2012/0202625 | A1 | | 8/2012 | McGibbon | |
| 2013/0045822 | A1 | | 2/2013 | Stefan | |

* cited by examiner

*Primary Examiner* — Mark Graham
(74) *Attorney, Agent, or Firm* — Brooks, Cameron & Huebsch, PLLC

(57) ABSTRACT

The present disclosure provides for a hockey goalie stick having a gripping aid that protrudes above the first major surface only in a handgrip area of the paddle. The hockey goalie stick includes a blade, a shaft having a width and a thickness, a paddle that extends between the blade and the shaft. The paddle has a first major surface and a second major surface opposite the first major surface with a maximum thickness equal to approximately the thickness of the shaft. The paddle includes a handgrip area having shoulders in which a width of the first major surface and the second major surface transitions to the width of the shaft. The gripping aid protrudes above the first major surface only in the handgrip area of the paddle.

20 Claims, 7 Drawing Sheets

HOCKEY GOALIE STICK

CROSS-REFERENCE TO RELATED APPLICATIONS

This application is a Non-Provisional Application that claims the benefit of U.S. Provisional Application No. 61/898,875, filed Nov. 1, 2013, the entire specification of which are incorporated herein by reference.

FIELD OF THE DISCLOSURE

The present disclosure relates generally to hockey sticks and more specifically to goalie hockey sticks.

BACKGROUND

Throughout history, many sports have been played on an ice surface, dating back as early as the Middle Ages. Modern ice hockey is considered to have evolved from outdoor stick-and-ball games adapted to the icy conditions of Canada in the 19th century, and the origin of the present National Hockey League (NHL) dates back to 1917. The NHL expanded into the United States in 1924, and by 1926 consisted of ten teams in Ontario, Quebec, the Great Lakes Region and the North Eastern United States. During the great depression, the NHL was reduced to six teams (now referred to as the "original six"), and by 1979, with the folding of the World Hockey Association (WHA), the NHL expanded to 21 teams. Today, ice hockey is played on six continents, is an Olympic sport, and, worldwide is the most popular game played on ice.

Over the history of the sport, ice hockey equipment has continually advanced. For example, in the early days, ice hockey sticks were made from hardwoods, such as maple and ash. The 1940's saw the introduction of laminated sticks, with layers of wood glued together to create a more flexible and durable design, and in the 1960's, companies began adding an additional lamination of synthetic compounds (such as fiberglass) to increase strength and durability. In the 1980's, manufacturers began experimenting with lightweight steel alloys, and introduced a single piece all aluminum stick. The aluminum stick was quickly replaced by a stick with an aluminum shaft and a removable wooden blade, which became very popular in the 1980's and early 1990's. In recent years, the manufacture of ice hockey sticks has largely moved to more advanced composite materials (such as fiberglass and carbon fiber), with some experimentation with materials such as Kevlar.

In ice hockey, the goaltender or goalie is the player who defends against the opposing team scoring by preventing or blocking shots of the puck by the opposing team from entering the net or goal. The goaltender uses a slightly modified stick as compared with the other players. The lower part of the shaft of the goalie stick and the blade are wider than other player sticks.

FIG. 1 illustrates a traditional ice hockey goalie stick 100. The goalie stick 100 includes a shaft 102 with a relatively narrow rectangular cross-sectional shape that resembles the shaft of a regular player stick. As with regular player sticks, the goaltender will typically tape the top of the shaft 102 of the goalie stick 100 with grip tape, forming a handle 108 and a knob 110. The goalie stick 100 also includes a paddle 104 that extends from the shaft 102. As illustrated, the paddle 104 is significantly wider than the shaft 102 (as much as 3-5 times wider than the shaft), and, while also generally rectangular in cross-sectional shape, is relatively flat with a curved face. Finally, the goalie stick 100 includes a blade 106 that extends from the paddle 104 at a heel 112 of the goalie stick 100 to a toe 114 of the goalie stick 100. The blade 106, which is the part of the stick that is generally placed along the ice and typically engages the puck, extends from the paddle 104 at an angle. The blade 106 takes on a similar shape to the paddle 104 (generally rectangular and flat in cross-section), but is shorter and typically curved with the concave surface facing the direction of play (the puck is generally played using the concave surface of the blade 106). Current goalie sticks are typically made from wood reinforced on the outside with woven fibers of glass, carbon fiber and/or Kevlar and bound to the surface with a resin (e.g., an epoxy resin), or similar composite materials as used for regular player sticks.

FIG. 2A illustrates the typical body and stick positioning of a goaltender during a typical block or save referred to as a butterfly save. The goaltender holds the goalie stick 200 in the blocker hand, which is the hand on which the blocker glove 216 is worn for deflecting pucks shot to that side of the net. On the other hand, the goaltender wears a catching glove 218 for catching pucks shot to that side of the net. A right-handed goaltender will typically wear the blocker on (and hold the goalie stick with) the right hand and the glove on the left, whereas a left-handed goaltender will typically do the reverse. The stick is generally held with the blade 206 on the ice, and the blade is typically used to block and deflect pucks shot at the net along the ice.

FIG. 2B illustrates the positioning of the goaltender's hand, within the blocker glove 216, while holding the goalie stick 200. Typically, the goaltender will grip the goalie stick 200 at the point where the shaft 202 meets the paddle 204. The goalie stick is generally gripped with a number of fingers and the thumb 212 wrapped around the shaft 202. Further, depending on the preference of the goaltender, either the index finger or the index and middle fingers are held over the face of the paddle 204 for stability (shown in FIG. 2B as only the index finger 214, with the other three fingers 212 wrapped around the shaft 202 along with the thumb (not shown)). The goaltender generally maneuvers the goalie stick utilizing the grip of the fingers 212 and thumb 214 around the shaft 204, and additional maneuverability and control are achieved via the one or two fingers 214 held over the face of the paddle 204 as discussed herein.

As ice hockey is played on an ice surface, aside from sports with artificial propulsion such as motor sports, it represents one of the fastest sports (if not the fastest sport) played today. For example, in the NHL, players reach skating speeds of over 20 miles per hour (mph). Further, in the NHL, the average passing speed of the puck from player to player is around 30 to 60 mph. Shots on goal reach even higher speeds. When the face of the stick blade strikes the puck, the player rolls his wrists and shifts his weight so that the energy stored in the stick is released through the puck. Further, an average wrist shot can reach speeds of 50-70 mph, with an exceptional wrist shot reaching upwards of 80 mph. A wrist shot represents a shot where the arms (predominantly wrist and forearm muscles), along with the lower body muscles, are used to fling or propel the puck towards the net. An average slapshot, on the other hand, can reach speeds of 70-90 mph, with upper bounds of over 100 mph. For example, former NHL great Bobby Hull is credited with the hardest slapshot on record, clocked on one occasion at a speed of 118.3 mph. A slapshot involves a wind up raising the hockey stick to shoulder height or more, a fast lowering of the stick to the ice and striking of the ice (slap) slightly behind the puck, using momentum and weight to bend the stick (storing energy in it like a spring), and a follow through. The bending of the stick results in the amazing speed of a slapshot (like a bow and arrow), with the flex of the stick transferring its energy to the puck.

Accordingly, when the immense speed and energy of such hockey shots strike the goaltender's stick, the energy of the puck is transferred to the goalie stick. Considering that the typical hockey puck consists of a disk of vulcanized rubber, weighing anywhere from 5-8 ounces (typically 6 ounces), and travelling at speeds of upwards of over 100 mph, that amounts to a significant amount of energy transferred to the goalie stick, when the goaltender makes a save with the blade 206 of the goalie stick 200. Further, the blade of the goalie stick acts like a lever, so when the puck strikes the stick, the energy of the puck transfers to the blade 206, resulting in a twisting force on the shaft of the stick in the goaltender's hand. The goaltender resists this twisting force on the goalie stick using the fingers 212 and 214 and thumb wrapped around the shaft 202 and predominantly with the one or two fingers 214 held over the face of the paddle 204. As would be understandable, such an immense force transferred to the goalie stick by the puck can require significant hand strength, and be significantly difficult to control via one or two fingers over the paddle 204 of the goalie stick 200. Moreover, general maneuverability is also somewhat difficult considering the size and weight of the goalie stick, and the fact that only one or two fingers over the paddle are used to maneuver and position the blade of the stick in preparation for blocking shots.

What is needed, therefore, is an improved goalie stick that can help the grip and control of the stick by the goaltender when maneuvering the stick and blocking shots.

SUMMARY OF THE DISCLOSURE

The present disclosure provides for a hockey goalie stick that can help assist the grip and control of the stick by the goaltender when maneuvering the stick and blocking shots. The hockey goalie stick includes a blade; a shaft having a width and a thickness; a paddle that extends between the blade and the shaft, the paddle having a first major surface and a second major surface opposite the first major surface with a maximum thickness equal to approximately the thickness of the shaft, where the paddle includes a handgrip area having shoulders in which a width of the first major surface and the second major surface transitions to the width of the shaft; and a gripping aid that protrudes above the first major surface only in the handgrip area of the paddle.

For the various embodiments, the griping aid protrudes above a first major surface of the paddle to a height of at least 10 percent the maximum thickness of the paddle. The gripping aid is also positioned in a particular area of the paddle. Specifically, the blade includes a toe and a heel distal to the toe. The paddle includes a heel edge and a toe edge between the first major surface and the second major surface. The heel edge extends from the heel of the blade along a length of the paddle. The toe edge, opposite the heel edge, extends from the blade along the length of the paddle. A longitudinal axis of the first major surface divides the paddle into a first elongate half and a second elongate half. The first elongate half extends from the longitudinal axis to the heel edge of the paddle and the second elongate half extends from the longitudinal axis to the toe edge. The gripping aid protrudes above the first elongate half of the first major surface of the paddle. In one embodiment, the griping aid protrudes above only the first elongate half of the first major surface of the paddle.

In addition to protruding above the first major surface of the paddle, the gripping aid has an elongate body with a longitudinal axis that is approximately parallel with an edge of a first shoulder of the handgrip area. The gripping aid has a shape selected from a semi-ellipsoid, a semi-cylinder, a semi-platonic solid, a semi-torus, a semi-spheroid, a semi-sphere or a combination thereof. In some embodiments, the gripping aid is integral with the paddle. For example, the gripping aid is formed of the same material as the paddle. Alternatively, the gripping aid is formed of a different material as the paddle. In a different embodiment, the gripping aid includes a sleeve that fits over at least a portion of the handgrip area. The sleeve can be releasably attached to the handgrip area.

In another embodiment, the gripping aid includes a number of mounting posts (e.g. a first mounting post and a second mounting post). In one such embodiment, the first mounting post and the second mounting post extend from an exterior surface of the gripping aid, and where the handgrip area includes a first socket and a second socket to receive the first mounting post and the second mounting post of the gripping aid. The first socket and the second socket releasably receive the first mounting post and the second mounting post of the gripping aid thereby allowing the gripping aid in the handgrip area to be replaced or for a different gripping aid (e.g., different size and/or shape) to be positioned thereon.

The gripping aid can have a surface that conforms to the shape of at least a portion of an index finger. The gripping aid can be formed from a variety of materials. For example, the gripping aid can be formed from a polymer.

BRIEF DESCRIPTION OF THE DRAWINGS

The present invention is illustrated by way of example, and not by way of limitation, in the figures of the accompanying drawings and in which like reference numerals refer to similar elements. The illustrations may not be to scale.

DETAILED DESCRIPTION

In accordance with example embodiments of the present invention, an improved apparatus for the shaft and paddle of a goalie stick to improve the grip and control of the stick by the goaltender when maneuvering the stick and blocking shots, is provided. Specifically, the present disclosure provides for a gripping aid that protrudes above a first major surface in the handgrip area of the paddle of a hockey goalie stick. The gripping aid helps to support the pointer finger and assist in gripping and controlling the hockey goalie stick.

In the following detailed description of the present disclosure, reference is made to the accompanying drawings that form a part hereof, and in which is shown by way of illustration how various embodiments of the disclosure may be practiced. These embodiments are described in sufficient detail to enable those of ordinary skill in the art to practice the embodiments of this disclosure, and it is to be understood that other embodiments may be utilized and that process or mechanical changes may be made without departing from the scope of the present disclosure.

Figure 1:
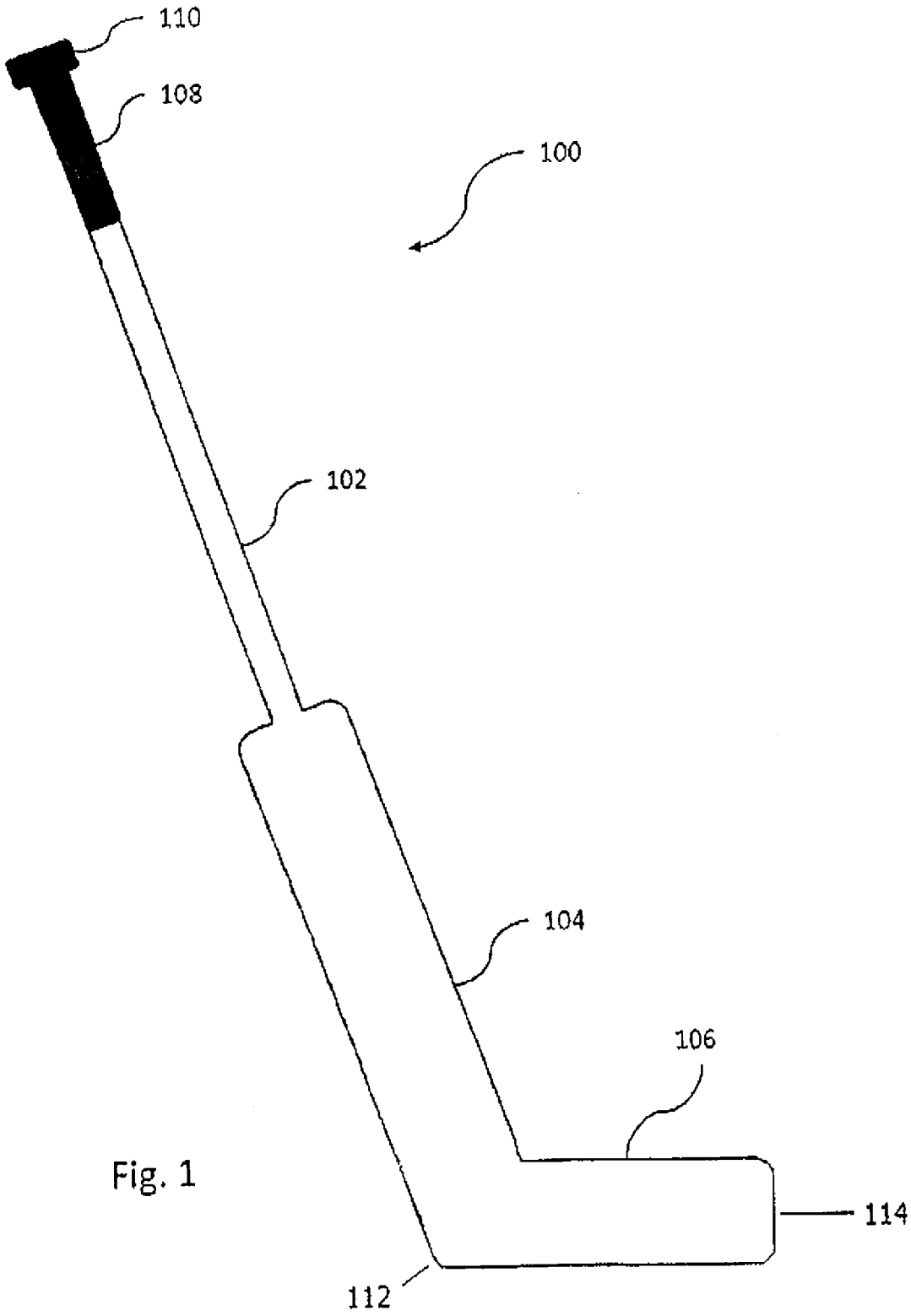
FIG. 1 illustrates a traditional ice hockey goaltender stick or goalie stick.
Figure 2A:
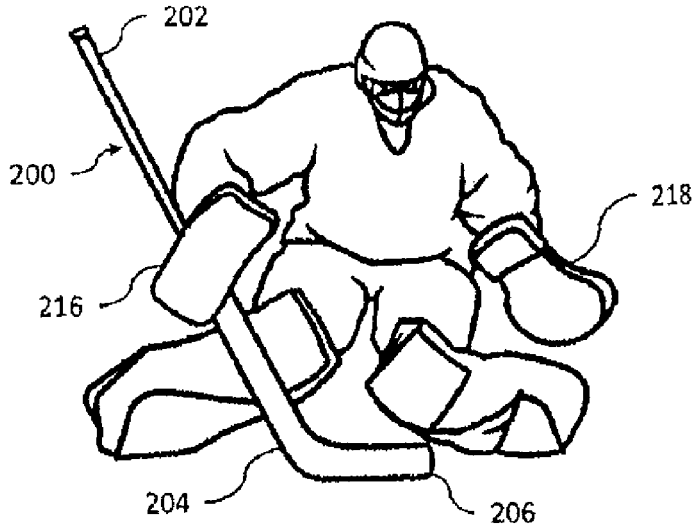
FIG. 2A illustrates the typical body and stick positioning of a goaltender during a typical block or save referred to as a butterfly save.
Figure 2B:
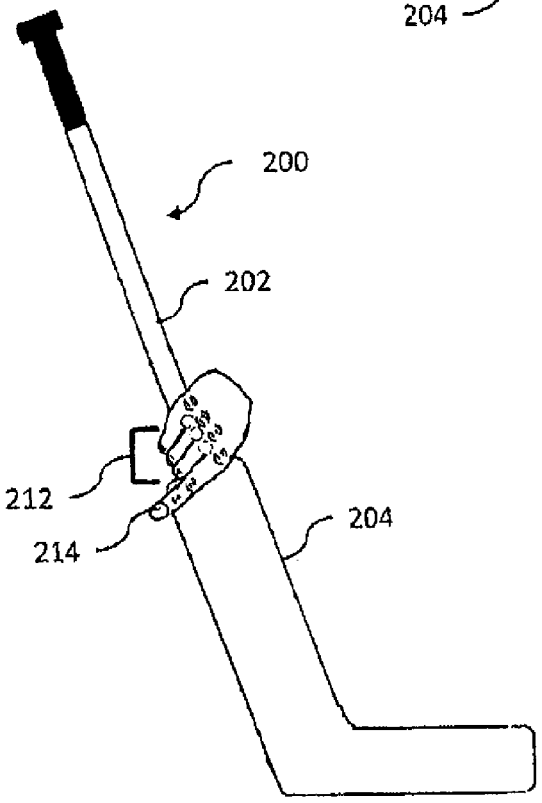
FIG. 2B illustrates the positioning of the goaltender's hand, within the blocker glove, while holding the goalie stick.
Figure 3:
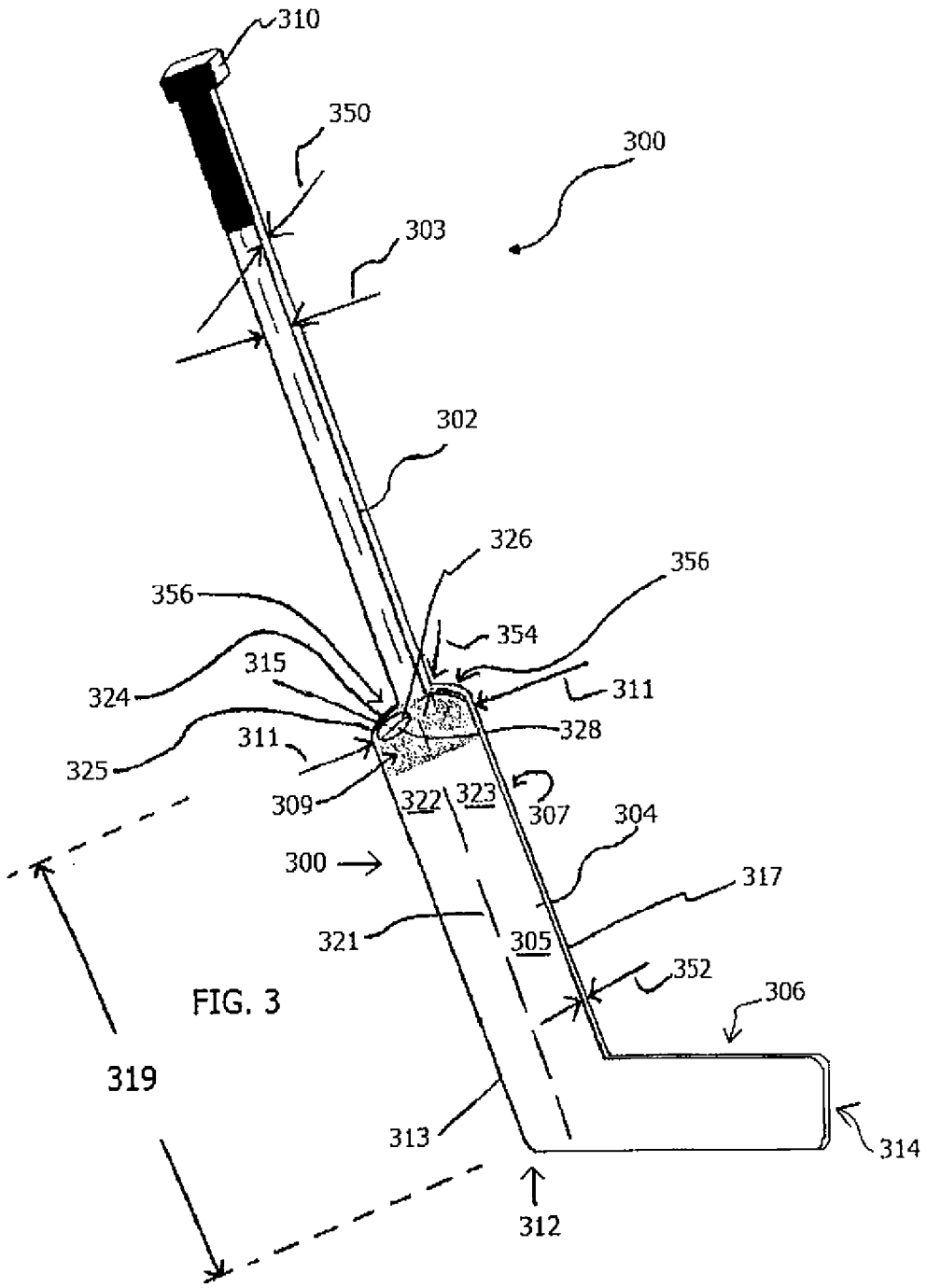
FIG. 3 illustrates an embodiment of the hockey goalie stick with a gripping aid according to the present disclosure.

Referring now to FIG. 3, there is shown one embodiment of the hockey goalie stick 300 according to the present disclosure. The hockey goalie stick 300 includes a blade 306, a shaft 302 having a width 303 and a thickness 350, a paddle 304 that extends between the blade 306 and the shaft 302. The paddle 304 has a first major surface 305 and a second major surface 307 opposite the first major surface 305. The paddle 304 has a thickness 352 between the first major surface 305 and the second major surface 307, with a maximum thickness 354 of approximately the thickness 350 of the shaft 302. The paddle 304 also includes a handgrip area 309 (shown with shading) having shoulders 356 in which a width 311 of the first major surface 305 and the second major surface 307 transitions to the width 303 of the shaft 302. FIG. 3 also shows a gripping aid 315 that protrudes above the first major surface 305 only in the handgrip area 309 of the paddle 304.

As illustrated, the blade 306 of the hockey goalie stick 300 also includes a toe 314 and a heel 312 distal to the toe 314. The paddle 304 includes a heel edge 313 and a toe edge 317 between the first major surface 305 and the second major surface 307. The heel edge 313 extends from the heel 312 of the blade 306 along a length 319 of the paddle 304. The toe edge 317, opposite the heel edge 313, extends from the blade 306 along the length 319 of the paddle 304. A longitudinal axis 321 of the first major surface 305 divides the paddle 304 into a first elongate half 322 and a second elongate half 323. The first elongate half 322 extends from the longitudinal axis 321 to the heel edge 313 of the paddle 304 and the second elongate half 323 extends from the longitudinal axis 321 to the toe edge 317. The gripping aid 315 protrudes above the first elongate half 322 of the first major surface 305 in the hand grip area 309 of the paddle 304. As illustrated in FIG. 3, the gripping aid 315 protrudes above only the first elongate half 322 of the first major surface 305 of the paddle 304. As will be more fully discussed herein, the griping aid 315 protrudes above the first major surface 305 of the paddle 304 to a height of at least 10 percent the maximum thickness 354 of the paddle 304.

The handgrip area 309 can be defined by the width 311 of the paddle 304 and a length of about 3 inches from where the paddle 304 meets the shaft 302 along the longitudinal axis 321 of the first major surface 305 of the paddle 304. As illustrated, the handgrip area 309 includes a first shoulder 324 on the first elongate half 322, where the first shoulder 324 has an edge 325 along which the width 311 of the first major surface 305 transitions to the width 303 of the shaft 302. The edge 325 can be straight or can be an arc, among other shapes. In the embodiment of FIG. 3, the gripping aid 315 has an elongate body 326 with a longitudinal axis 328 that is approximately parallel with the edge 325 of the first shoulder 324, however, other orientations may be utilized in other embodiments.

The gripping aid 315 can have a shape selected from a semi-ellipsoid, a semi-cylinder, a semi-platonic solid, a semi-torus, a semi-spheroid, a semi-sphere or a combination thereof. The gripping aid 315 can have a surface that conforms to the shape of at least a portion of an index finger.

The gripping aid 315 can be integral with the paddle 304. For example, the material used to form the gripping aid 315, to be discussed more fully herein, can be joined to or formed with the paddle 304 either in its final shape or can be in a shape from which the shape of the gripping aid 315 is formed. For example, in forming the goalie hockey stick 300 using a composite material, as discussed herein, the shape of the gripping aid 315 is formed during the lay-up process. For example, during the lay-up process the composite material is shaped to project or to deviate away from the general overall shape of first major surface 305 into the shape of the gripping aid 315.

Alternatively, the material used to form the gripping aid 315 is joined to the first major surface 305. So, for example, the gripping aid 315 and the hockey goalie stick with its paddle 304 start off as two separate pieces. The gripping aid 315 is joined to the paddle 304. Joining of these pieces can be accomplished in a variety of ways. For example, the gripping aid 315 and the paddle 304 can be joined using an adhesive, can be fused together, or a combination thereof. For example, suitable adhesives include reactive and non-reactive adhesives. Reactive adhesives can include adhesives such as one-part or two-part adhesives. Examples include, but are not limited to, acrylics, urethane, and epoxy adhesives. Non-reactive adhesives include, but are not limited to, pressure sensitive adhesives, solvent based adhesives, polymer dispersion adhesives, or hot adhesives. The adhesive can be part of a double sided tape that can be used to join the gripping aid 315 to the first major surface 305.

As mentioned, the gripping aid 315 can be joined to the first major surface 305 of the hockey goalie stick in its final shape or as a shape that will be changed into the final shape of the gripping aid 315 after it has be joined to the hockey goalie stick. For example, such a change in shape can be accomplished using tools such as a grinder, a file, a sander, a milling machine (e.g., CAD/CAM) among other machines known in the art. In such embodiments, the material to become the gripping aid 315 is joined to the first major surface 305 (e.g., joined using an adhesive), after which one or more of tools discussed herein are used to change the shape of the material into the gripping aid 315.

Once the gripping aid 315 is joined to the first major surface 305, the hockey goalie stick can undergo one or more additional production steps. For example, the surface of the gripping aid 315 can be changed relative to the surface of the rest of the paddle 304. So, in one embodiment, the texture of the surface of the gripping aid 315 can be changed relative to the rest of the paddle 304 (e.g., made rougher or smoother relative to the rest of the paddle 304, a pattern could be applied or formed). Alternatively, a coating could be added over at least a portion of the gripping aid 315 to provide a degree of adhesion between the gripping aid 315 and the blocker glove of the goalie.

The gripping aid can be formed of the same material as the paddle. Alternatively, the gripping aid can be formed of a different material as the paddle. Examples of such materials used to form the gripping aid, and the other parts of the hockey goalie stick, include wood (e.g., solid or plywood); a wood composite of layers of wood and a reinforcing material, such as fiberglass or carbon fiber; aluminum; hockey tape (e.g., cloth hockey tape); titanium; carbon fiber; Kevlar; and a composite of carbon fiber and fiberglass. When wood or wood composite is used in forming the hockey goal stick, the surface of the blade, the paddle and the gripping aid can be coated with a reinforcing layer(s) of fiberglass, carbon fiber and/or Kevlar that is held in place (or bonded) with a resin (e.g., an epoxy resin).

In an alternative embodiment, the gripping aid can be formed of a polymer. For example, the gripping aid can be formed of a thermoset polymer or a thermoplastic polymer. Examples of thermoplastic polymers include, but are not limited to, poly(methyl methacylate), polyethylene, nylon(s), polypropylene, polystyrene, polyvinyl chloride, among others. Examples of thermoset polymers include natural rubber, synthetic rubber and polyurethane, among others. Examples of synthetic rubbers include silicone rubber (e.g., polysiloxane), polyisoprene, polychloroprene, isobutylene isoprene butyl, acrylonitrile butadiene, and those derived from butadiene and styrene, among others.

Figure 4:
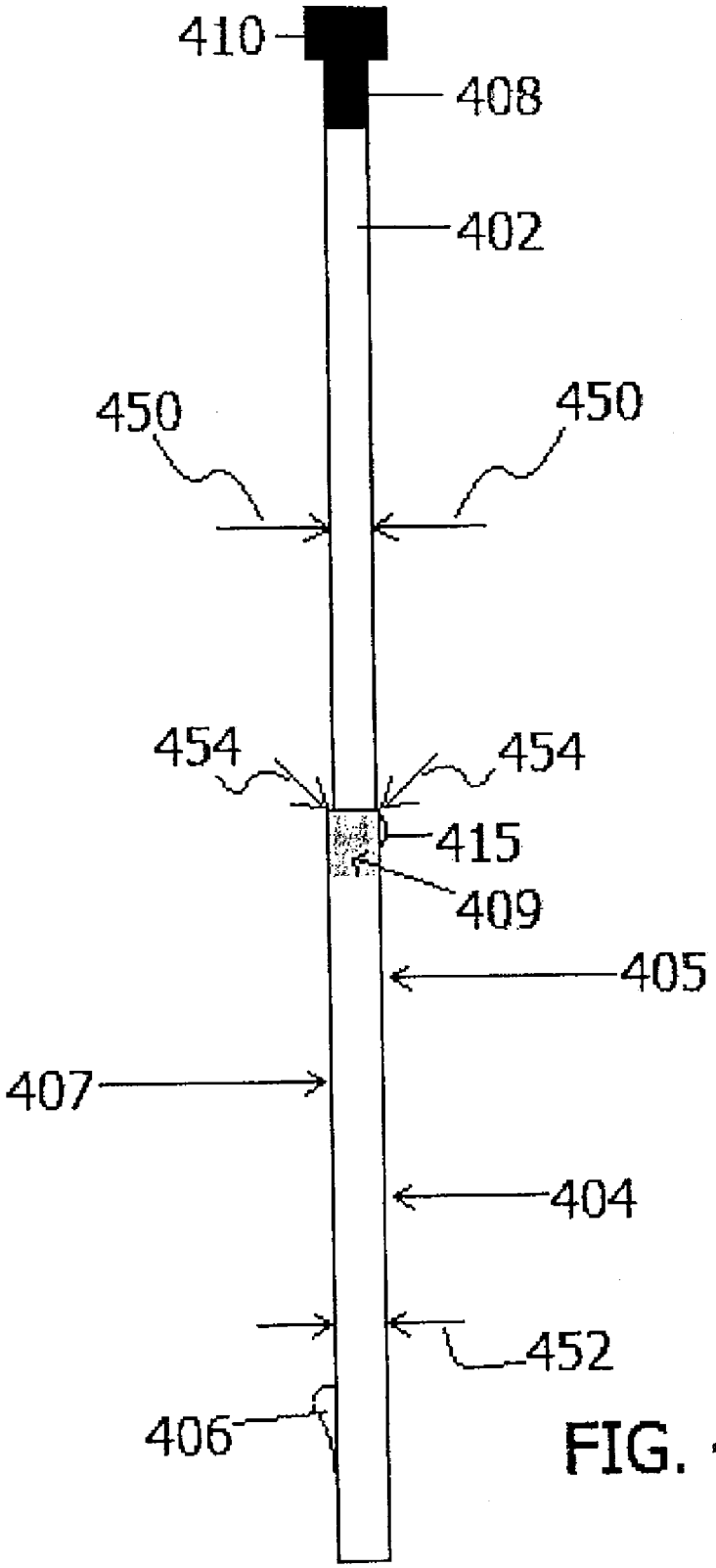
FIG. 4 illustrates a side view of an embodiment of the hockey goalie stick according to the present disclosure.

Referring now to FIG. 4, there is shown a side view of an embodiment of the hockey goalie stick 400 according to the present disclosure. The hockey goalie stick 400 includes the blade 406, the shaft 402 having the thickness 450, and the paddle 404 that extends between the blade 406 and the shaft 402. The paddle 404 has the first major surface 405 and the second major surface 407 opposite the first major surface 405. The paddle 404 has the thickness 452 between the first major surface 405 and the second major surface 407, with the maximum thickness 454 of approximately the thickness 450 of the shaft 402. FIG. 4 also shows the gripping aid 415 that protrudes above the first major surface 405 only in the handgrip area 409 of the paddle 404.

As discussed, the griping aid 415 protrudes above the first major surface 405 of the paddle 404 to a maximum height of at least 10 percent the maximum thickness 454 of the paddle 404. The point of maximum height of the griping aid 415 can be taken along a line that is perpendicular to the first major surface 405 and the longitudinal axis of the paddle 404. So, for example, the griping aid 415 protrudes above the first major surface 405 of the paddle 404 to a maximum height of 10 percent to 150 percent the maximum thickness 454 of the paddle 404. In an additional example, the griping aid 415 protrudes above the first major surface 405 of the paddle 404 to a maximum height of 30 percent to 150 percent the maximum thickness 454 of the paddle 404. In a further example, the griping aid 415 protrudes above the first major surface 405 of the paddle 404 to a maximum height of 40 percent to 75 percent the maximum thickness 454 of the paddle 404. Other values are possible.

Figure 5:
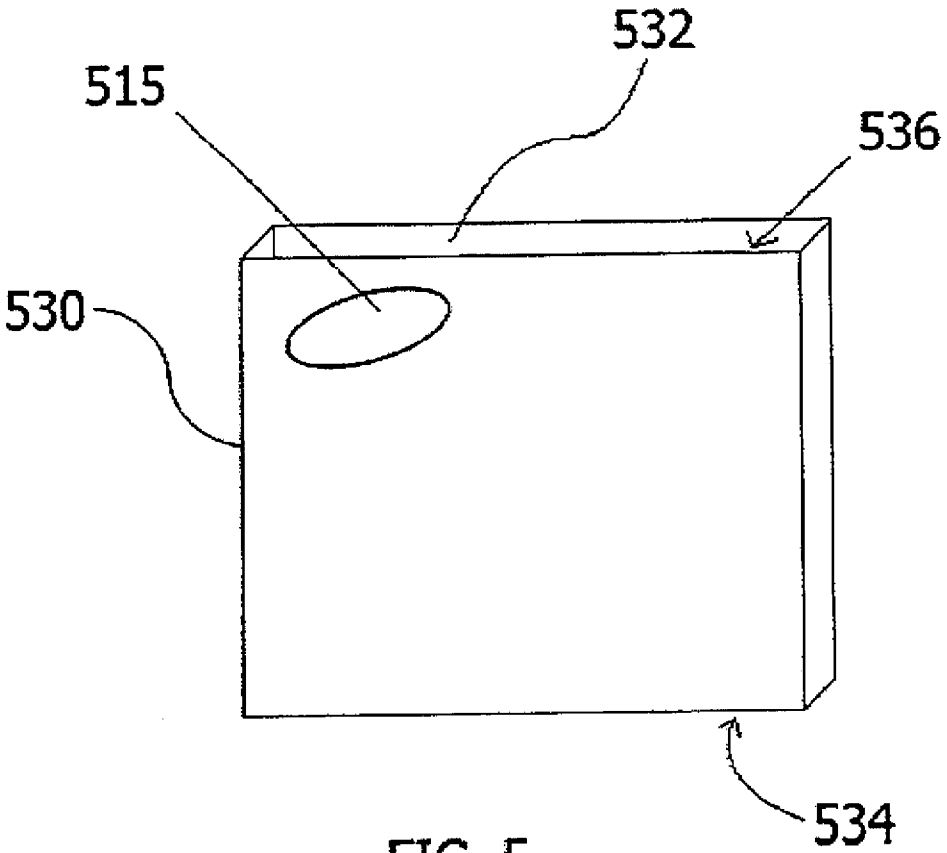
FIG. 5 illustrates an embodiment of the gripping aid with a sleeve according to the present disclosure.

Referring now to FIG. 5, where is shown an additional embodiment of the gripping aid 515 according to the present disclosure. As illustrated, the gripping aid 515 includes a sleeve 530 that fits over at least a portion of the handgrip area of the hockey goalie stick. This embodiment of the present disclosure can be used with the "traditional goalie" stick as discussed herein.

As illustrated, the sleeve 530 can have an inner surface 532 that is shaped to fit closely around at least a portion of the paddle in the area where it connects to the shaft. The inner surface 532 of the sleeve 530 also helps to define both a first opening 534 and a second opening 536. The shaft can pass through both the first opening 534 and the second opening 536. At least a portion of the paddle then passes through the first opening 534. Depending upon the configuration of sleeve 530, the second opening 536 can be positioned in a variety of locations relative to the paddle and the shaft. For example, at least a portion of the paddle can also pass through the second opening 536 when the sleeve 530 is in position on the hockey goalie stick. Alternatively, the surfaces defining the second opening 536 can extend along the first shoulder and the second shoulder of the paddle when the sleeve 530 is in position on the hockey goalie stick. In another embodiment, the surfaces defining the second opening 536 fit around the shaft, but not the paddle, when the sleeve 530 is in position on the hockey goalie stick.

For the various embodiments, the sleeve 530 of the gripping aid 515 can have an elasticity that allows it to be stretched over the paddle and/or the shaft to allow the gripping aid 515 to be positioned on the paddle as discussed herein. For this embodiment, the gripping aid 515 and the sleeve 530 can be formed of the same or different materials, as discussed herein. For example, both the gripping aid 515 and the sleeve 530 can be formed from the thermoset polymers, discussed herein. As the sleeve 530 of the gripping aid 515 is elastic, the sleeve 530 can be releasably attached to the handgrip area of the hockey goalie stick.

Figure 6:
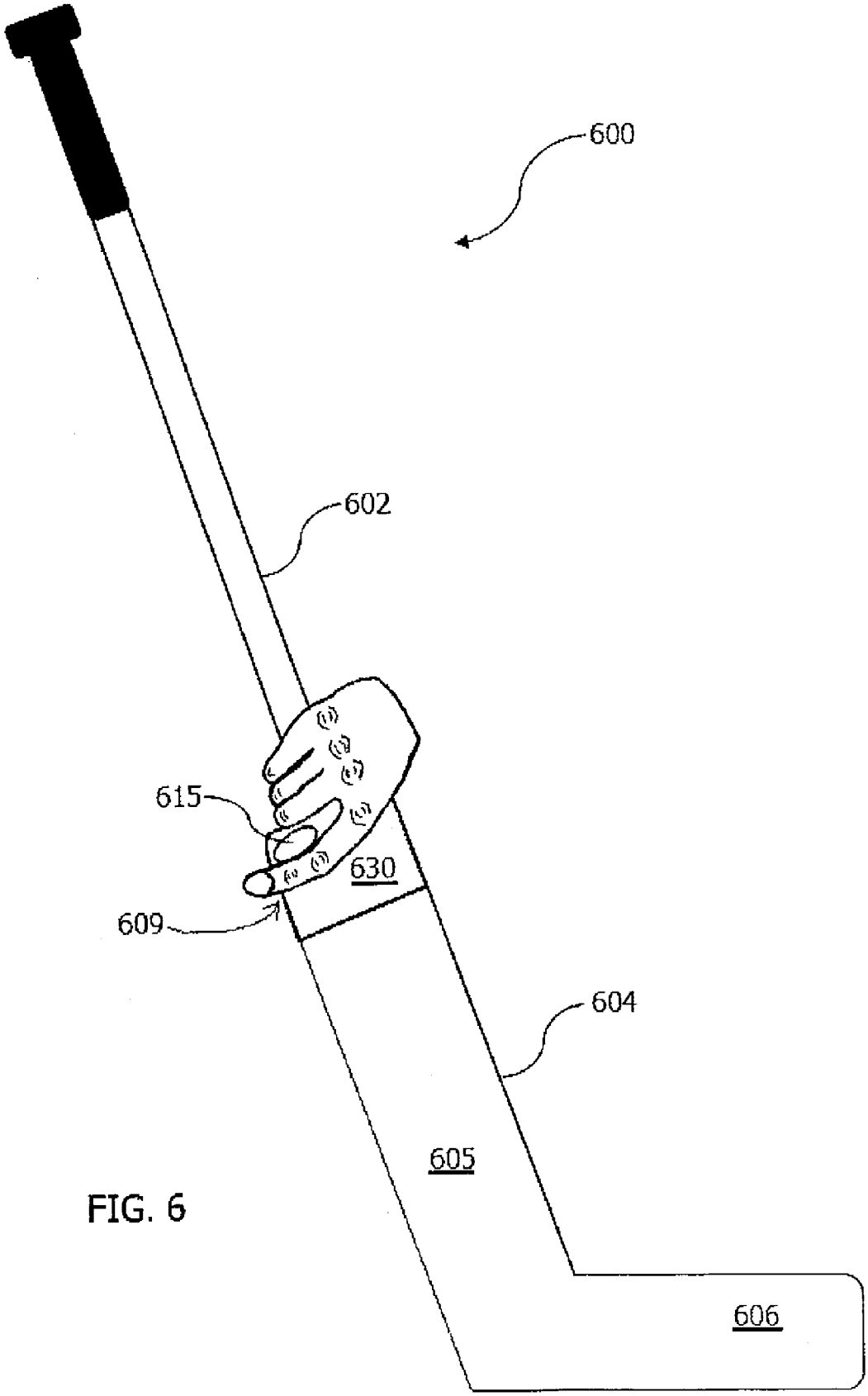
FIG. 6 illustrates a hockey goalie stick having the gripping aid with a sleeve according to the present disclosure.

Referring now to FIG. 6 there is shown an embodiment of the gripping aid 615 with the sleeve 630 positioned on a hockey goalie stick 600. As illustrated, the sleeve 630 fits over at least a portion of the handgrip area 609 of the hockey goalie stick 600, where the hockey goalie stick 600 is a "traditional goalie" stick as discussed herein. As illustrated, the sleeve 630 fits closely around at least a portion of the paddle 604 in the area where it connects to the shaft 602. The sleeve 630 of the gripping aid 615 has an elasticity that allows it to be stretched over the paddle and/or the shaft to allow the gripping aid 615 to be releasably positioned on the paddle 604.

Figure 7:
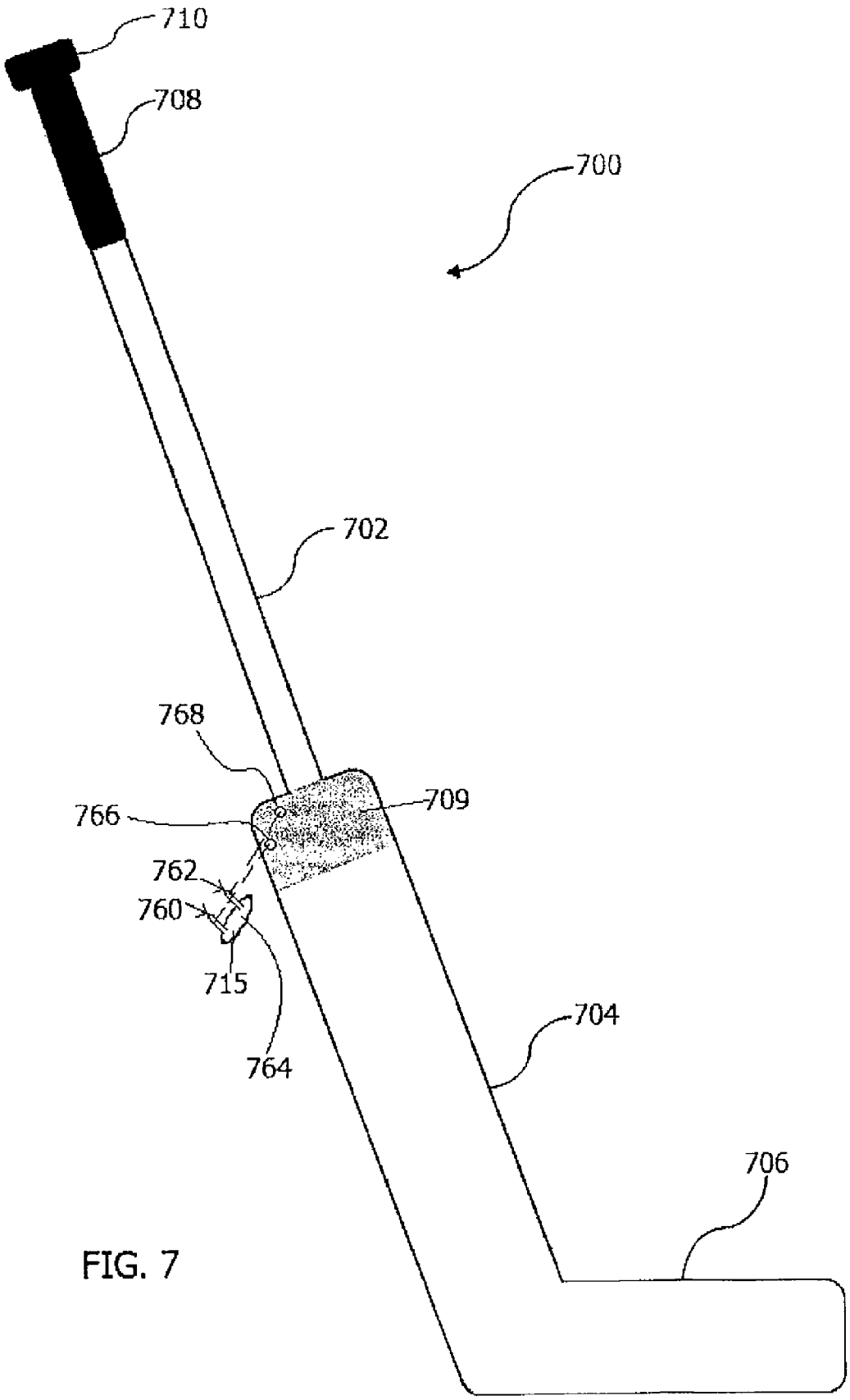
FIG. 7 illustrates an embodiment of the hockey goalie stick with a gripping aid according to the present disclosure.

Referring now to FIG. 7 there is shown another embodiment of the gripping aid 715 according to the present disclosure, positioned on a hockey goalie stick 700. As illustrated, the gripping aid 715 includes a first mounting post 760 and a second mounting post 762, where the first mounting post 760 and the second mounting post 762 extend from an exterior surface 764 of the gripping aid 715. The handgrip area 709 includes a first socket 766 and a second socket 768 to receive the first mounting post 760 and the second mounting post 762 of the gripping aid 715. The first socket 766 and the second socket 768 releasably receive the first mounting post 760 and the second mounting post 762 of the gripping aid 715 thereby allowing the gripping aid 715 in the handgrip area 709 to be replaced. The first mounting post 760 and the second mounting post 762 can be rigid to allow them to be inserted and removed from the first socket 766 and the second socket 768 as desired by the user. Alternatively, the gripping aid 715 can be permanently positioned on the paddle 704 by using an adhesive, as discussed herein, to join the first mounting post 760 and the second mounting post 762 and the gripping aid 715 to the paddle 704.

Although specific embodiments have been illustrated and described herein, those of ordinary skill in the art will appreciate that an arrangement calculated to achieve the same results can be substituted for the specific embodiments shown. This disclosure is intended to cover adaptations or variations of various embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A hockey goalie stick, comprising:

a blade, where the blade includes a toe and a heel distal to the toe;

a shaft having a width and a thickness;

a paddle that extends between the blade and the shaft, the paddle having a first major surface and a second major surface opposite the first major surface with a maximum thickness equal to approximately the thickness of the shaft, where the paddle includes a handgrip area having shoulders in which a width of the first major surface and the second major surface transitions to the width of the shaft, the paddle further including a heel edge and a toe edge between the first major surface and the second major surface, where:

the heel edge extends from the heel of the blade along a length of the paddle;

the toe edge, opposite the heel edge, extends from the blade along the length of the paddle; and where a longitudinal axis of the first major surface divides the paddle into a first elongate half and a second elongate half, where the first elongate half extends from the longitudinal axis to the heel edge of the paddle and the second elongate half extends from the longitudinal axis to the toe edge; and a gripping aid integral with the paddle, where the gripping aid protrudes above the first elongate half of the first major surface of the paddle and has a semi-ellipsoid elongate body with a longitudinal axis that is approximately parallel with an edge of a first shoulder of the handgrip area of the paddle.

2. The hockey goalie stick of claim 1, where the gripping aid protrudes above the first major surface of the paddle to a height of at least 10 percent the maximum thickness of the paddle.

3. The hockey goalie stick of claim 1, where the gripping aid is integral with the paddle.

4. The hockey goalie stick of claim 3, where the gripping aid is formed of the same material as the paddle.

5. The hockey goalie stick of claim 3, where the gripping aid is formed of a different material than the paddle.

6. The hockey goalie stick of claim 1, where the gripping aid has a surface that conforms to the shape of at least a portion of an index finger.

7. The hockey goalie stick of claim 1, where the gripping aid is formed of a polymer.

8. A hockey goalie stick, comprising:

a blade;

a shaft having a width and a thickness;

a paddle that extends between the blade and the shaft, the paddle having a first major surface and a second major surface opposite the first major surface with a maximum thickness equal to approximately the thickness of the shaft, where the paddle includes a handgrip area having shoulders in which a width of the first major surface and the second major surface transitions to the width of the shaft; and a gripping aid that protrudes above the first major surface only in the handgrip area of the paddle, where the gripping aid includes a first mounting post and a second mounting post, where the first mounting post and the second mounting post extend from an exterior surface of the gripping aid, and where the handgrip area includes a first socket and a second socket to receive the first mounting post and the second mounting post of the gripping aid.

9. The hockey goalie stick of claim 8, where the first socket and the second socket releasably receive the first mounting post and the second mounting post of the gripping aid thereby allowing the gripping aid in the handgrip area to be replaced.

10. The hockey goalie stick of claim 8, where the gripping aid protrudes above the first major surface of the paddle to a height of at least 10 percent the maximum thickness of the paddle.

11. The hockey goalie stick of claim 8, where the gripping aid has a surface that conforms to the shape of at least a portion of an index finger.

12. The hockey goalie stick of claim 8, where the gripping aid is formed of a polymer.

13. A hockey goalie stick, comprising:

a blade;

a shaft having a width and a thickness;

a paddle that extends between the blade and the shaft, the paddle having a first major surface and a second major surface opposite the first major surface with a maximum thickness equal to approximately the thickness of the shaft, where the paddle includes a handgrip area having shoulders in which a width of the first major surface and the second major surface transitions to the width of the shaft, the handgrip area being defined by the width of the paddle and a length of about 3 inches from where the paddle meets the shaft along a longitudinal axis of the first major surface of the paddle and where the handgrip area includes a first shoulder on the first elongate half, the first shoulder having a linear edge along which the width of the first major surface transitions to the width of the shaft; and a gripping aid that protrudes above the first major surface only in the handgrip area of the paddle, where the gripping aid has an elongate body with a longitudinal axis that is approximately parallel with the linear edge of the first shoulder.

14. The hockey goalie stick of claim 13, where the gripping aid protrudes above the first major surface of the paddle to a height of at least 10 percent the maximum thickness of the paddle.

15. The hockey goalie stick of claim 13, where the gripping aid has a shape selected from a semi-ellipsoid, a semi-cylinder, a semi-platonic solid, a semi-torus, a semi-spheroid, a semi-sphere or a combination thereof.

16. The hockey goalie stick of claim 13, where the gripping aid is integral with the paddle.

17. The hockey goalie stick of claim 16, where the gripping aid is formed of the same material as the paddle.

18. The hockey goalie stick of claim 16, where the gripping aid is formed of a different material than the paddle.

19. The hockey goalie stick of claim 13, where the gripping aid has a surface that conforms to the shape of at least a portion of an index finger.

20. The hockey goalie stick of claim 13, where the gripping aid is formed of a polymer.

* * * * *